US008177031B2

(12) United States Patent
Flynn et al.

(10) Patent No.: US 8,177,031 B2
(45) Date of Patent: May 15, 2012

(54) COMMISSIONING OF ELEVATOR HALLWAY FIXTURES IN A DESTINATION ENTRY GROUP ELEVATOR SYSTEM

(75) Inventors: Michael P. Flynn, Avon, CT (US); Paul A. Stranieri, Bristol, CT (US); Wade Montague, Southington, CT (US); Richard Mangini, Brookfield, CT (US)

(73) Assignee: Otis Elevator Company, Farmington, CT (US)

( * ) Notice: Subject to any disclaimer, the term of this patent is extended or adjusted under 35 U.S.C. 154(b) by 621 days.

(21) Appl. No.: 12/084,946

(22) PCT Filed: Nov. 16, 2005

(86) PCT No.: PCT/US2005/041338

§ 371 (c)(1),
(2), (4) Date: Jul. 2, 2009

(87) PCT Pub. No.: WO2007/061405

PCT Pub. Date: May 31, 2007

(65) Prior Publication Data

US 2009/0288919 A1 Nov. 26, 2009

(51) Int. Cl.
*B66B 1/28* (2006.01)

(52) U.S. Cl. ..... 187/247; 187/391

(58) Field of Classification Search ..... 187/247, 187/248, 391–396

See application file for complete search history.

(56) References Cited

U.S. PATENT DOCUMENTS

| | | | | |
|---|---|---|---|---|
| 4,193,478 | A * | 3/1980 | Keller et al. | 187/247 |
| 4,497,391 | A * | 2/1985 | Mendelsohn et al. | 187/380 |
| 4,765,442 | A * | 8/1988 | Blain et al. | 187/247 |
| 4,766,978 | A * | 8/1988 | Blain et al. | 187/247 |
| 4,785,914 | A * | 11/1988 | Blain et al. | 187/280 |
| 5,391,848 | A | 2/1995 | Murphy | |
| 5,561,277 | A * | 10/1996 | Bockhold et al. | 187/247 |
| 5,654,531 | A | 8/1997 | Farabee et al. | |
| 6,065,570 | A | 5/2000 | Friedli et al. | |
| 6,173,814 | B1 * | 1/2001 | Herkel et al. | 187/288 |
| 6,467,583 | B1 | 10/2002 | Koura et al. | |
| 6,471,011 | B1 | 10/2002 | Ando et al. | |
| 6,672,429 | B1 | 1/2004 | Thurmond, III | |
| 2009/0283369 | A1 * | 11/2009 | Flynn et al. | 187/391 |
| 2011/0120813 | A1 * | 5/2011 | Flynn et al. | 187/384 |

FOREIGN PATENT DOCUMENTS

JP 5139646 A 6/1993

(Continued)

OTHER PUBLICATIONS

Official Search Report of the Patent Cooperation Treaty in counterpart foreign Application No. PCT/US05/41338 filed on Nov. 16, 2005.

(Continued)

*Primary Examiner* — Anthony Salata

(74) *Attorney, Agent, or Firm* — Kinney & Lange, P.A.

(57) ABSTRACT

A destination entry input device (30, 35) is commissioned in a group elevator system (10). The destination entry input device (30, 35) is connected to a dispatch controller (20). A network address is input into the destination entry input device (30, 35) corresponding to an installation location of the destination entry input device (30, 35). When the network address is input, installation location information related to the installation location of the destination entry input device is downloaded to the destination entry input device (30, 35) and verified.

17 Claims, 3 Drawing Sheets

FOREIGN PATENT DOCUMENTS

| | | | |
|---|---|---|---|
| JP | 6001552 | A | 1/1994 |
| JP | 6247653 | A | 9/1994 |
| JP | 6290669 | A | 10/1994 |
| JP | 10203746 | A | 8/1998 |
| JP | 2005050302 | A | 2/2005 |
| JP | 2007084244 | A | 4/2007 |
| KR | 1020050088619 | | 7/2005 |
| WO | 0174702 | A1 | 10/2001 |

OTHER PUBLICATIONS

China First Office Action, Jun. 23, 2010, 6 pages.
Korea, Notification of Reason(s) for Refusal, Jan. 23, 2010, 3 pages.
Japanese Patent Office, Japanese Office Action, Aug. 23, 2011, 3 pages.
Espacenet, Bibliographic data-Abstract of JP1288586, Jan. 25, 2012, 1 page.

* cited by examiner

COMMISSIONING OF ELEVATOR HALLWAY FIXTURES IN A DESTINATION ENTRY GROUP ELEVATOR SYSTEM

BACKGROUND OF THE INVENTION

The present invention relates to the field of elevator control, and in particular to installation and network registration of elevator hallway fixtures in a destination entry group elevator system.

Conventional group elevator systems include hall call modules near the elevators on each floor. Typically, the hall call modules include up and down buttons that are pressed by passengers when elevator service is desired. Each hall call module is assigned a network address that an elevator controller uses to associate the hall call module with its floor location. When one of the buttons on the hall call module is pressed, the elevator controller assigns an elevator that will most efficiently deliver the passengers in the desired direction. The elevator controller determines which floor to send an elevator to based on the network address of the hall call module on which a button was pressed.

When a hall call module is delivered to a building for installation, it must be configured with the network address associated with the floor on which it is going to be installed. All hall call modules on a floor are configured with the same network address, since an elevator is dispatched to the floor after pressing a button on any of the hall call modules on the floor. The hall call modules can later be tested for proper function by simply pressing the buttons on each hall call module and assuring that an elevator is dispatched according to the button pressed.

Recently, elevator systems with destination entry have been introduced. In a destination entry system, passengers are required to register their destination floors before they are picked up. The group elevator system assigns each passenger to an elevator that most efficiently transports him or her to the desired destination floor. Passengers register their destination floors on destination entry devices, which are mounted near the elevators and can take the form of a numeric keypad or a touch screen display.

The destination entry devices often include audio and visual capabilities, for example to direct a passenger toward the elevator assigned based on input provided on the destination entry device. The directional output provided to the passenger depends on the location of the destination entry device relative to the assigned elevator. Consequently, each destination entry device in a building (including those on the same floor) is assigned a unique network address so that, based on the network address of the destination entry device used to register the destination, the elevator controller can determine the appropriate directional and distance output.

At present, each destination entry device is configured with its unique network address prior to installation. At a later time, each destination entry device must then be tested to assure proper function. In destination entry systems, each device must be tested to assure that the correct software is installed and that every key works properly. In addition, it must be verified that various destination entries on the device each result in an accurate directional and distance output on the display, and that each elevator is dispatched according to a destination registered on a destination entry device. This is an elaborate, time-intensive commissioning process, especially in larger buildings having a large number of destination entry devices.

BRIEF SUMMARY OF THE INVENTION

The subject invention is directed to the commissioning of a destination entry input device in a group elevator system. The destination entry input device is connected to a dispatch controller. A network address is input into the destination entry input device corresponding to an installation location of the destination entry input device. When the network address is input, installation location information related to the installation location of the destination entry input device is downloaded to the destination entry input device and verified.

DETAILED DESCRIPTION

Figure 1:
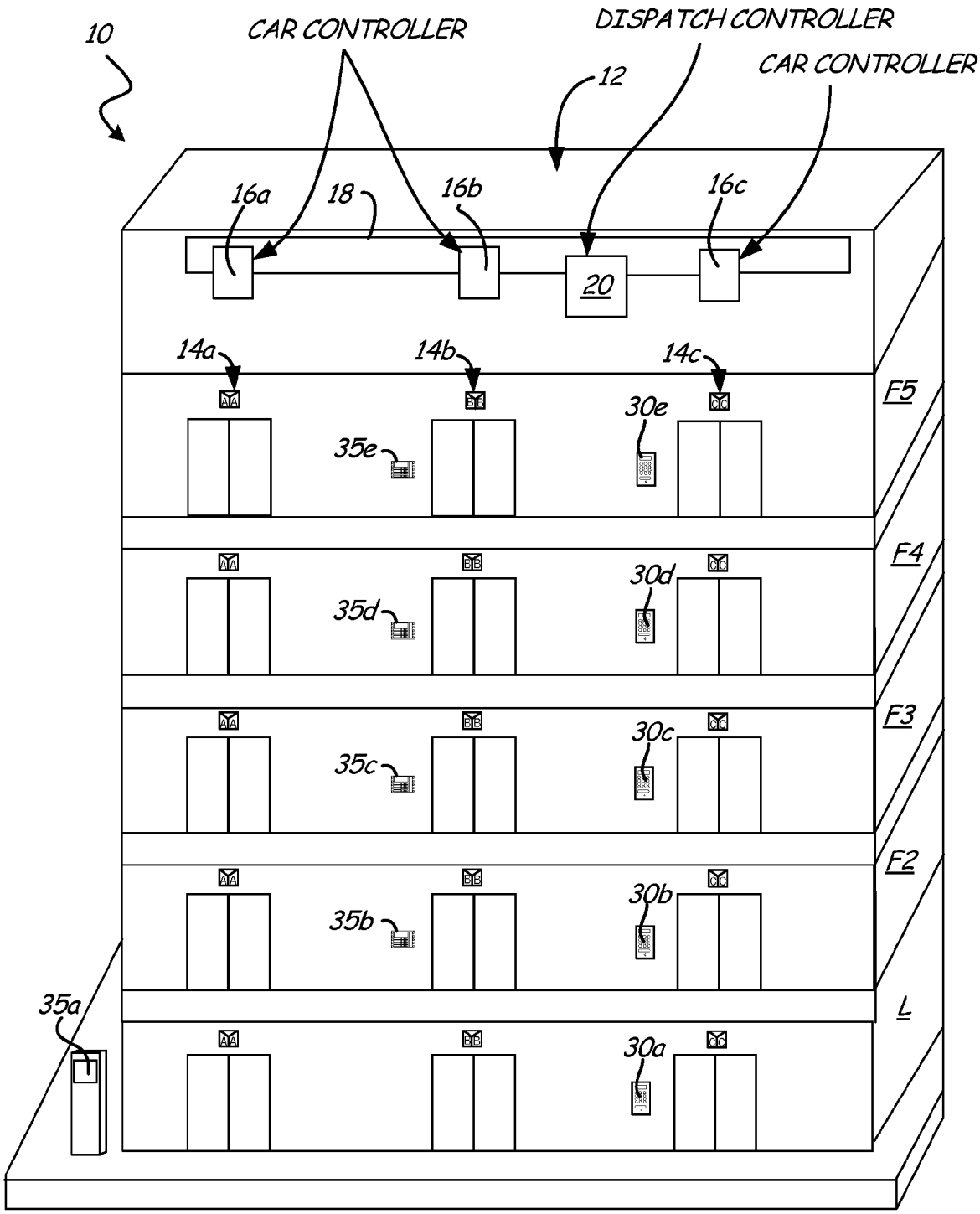
FIG. 1 is a perspective view of a destination entry group elevator system.

FIG. 1 is a perspective view of destination entry based elevator system 10 in building 12. Building 12 includes five floors, including lobby floor L, second floor F2, third floor F3, fourth floor F4, and fifth floor F5. Group elevator system 10 includes three elevators 14*a*, 14*b*, and 14*c*, each of which is operable to transport passengers to any of the floors in building 12. While three elevators 14*a*-14*c* and five floors L and F2-F5 are shown, it will be appreciated that the present invention is applicable to destination entry group elevator systems with any number of elevators servicing any number of floors.

The operation of each elevator is controlled by a dedicated car controller. In particular, elevator 14*a* is controlled by car controller 16*a*, elevator 14*b* is controlled by car controller 16*b*, and elevator 14*c* is controlled by car controller 16*c*. Car controllers 16*a*-16*c* are connected to and communicate with each other via communications loop 18.

Car controllers 16*a*-16*c* control elevators 14*a*-14*c*, respectively, based on elevator control information received from dispatch controller 20. Dispatch controller 20 is connected to car controllers 16*a*-16*c* via communications loop 18. Dispatch controller 20 processes destination input information received via communications lines (not shown) and provides elevator control information based on the destination input information.

Destination input information is provided by passengers via destination entry input devices located on each floor. The destination entry input devices are located next to the elevators on each floor and are used by passengers to enter their desired destination floor via numbered keys on the input device. The destination entry input devices may also include keys labeled for specific areas of the building such that a passenger may press the labeled keys to be transported directly to the area on the key. In group elevator system 10, the destination entry input devices include keypads 30*a*, 30*b*, 30*c*, 30*d*, and 30*e*, and touch screen displays 35*a*, 35*b*, 35*c*, 35*d*, and 35*e*, together with digital circuitry that receives inputs from a keypad 30*a*-30*e*, displays information on touch screen displays 35*a*-35*e*, and communicates with dispatch controller 20. Keypads 30 will be described in more detail with regard to FIG. 2, and touch screen display 35 will be described in more detail with regard to FIG. 3. The digital circuitry associated with each keypad 30 and touch screen display 35 is connected to dispatch controller 20 via a data line (not shown). The commissioning process for installing and configuring keypads 30 and touch screen displays 35 according to the present invention will be described with regard to FIG. 4. It will be appreciated that any combination of keypads 30 and touch screen displays 35 may be employed throughout building 12.

The scheduling of elevators 14*a*-14*c* is coordinated by dispatch controller 20 based on the destination input information provided on keypads 30 and touch screen displays 35. Elevators 14*a*-14*c* are independent, but are coupled through serving a common pool of passengers. For each passenger, there is only one elevator 14 that will serve that passenger. As each passenger enters his or her destination floor on one of keypads 30 or touch screen displays 35, the passenger is directed to an elevator that will most efficiently service his or her destination request. Dispatch controller 20 communicates with car controllers 16*a*-16*c* to determine the locations of elevators 14*a*-14*c* when assigning passengers to an elevator. When passengers enter their assigned elevator, the car controller controls the elevator so as to stop only at those floors that passengers on the assigned elevator requested. By grouping passengers in this way, passengers reach their destination floor in an efficient manner with fewer stops than in conventional elevator systems.

Figure 2:
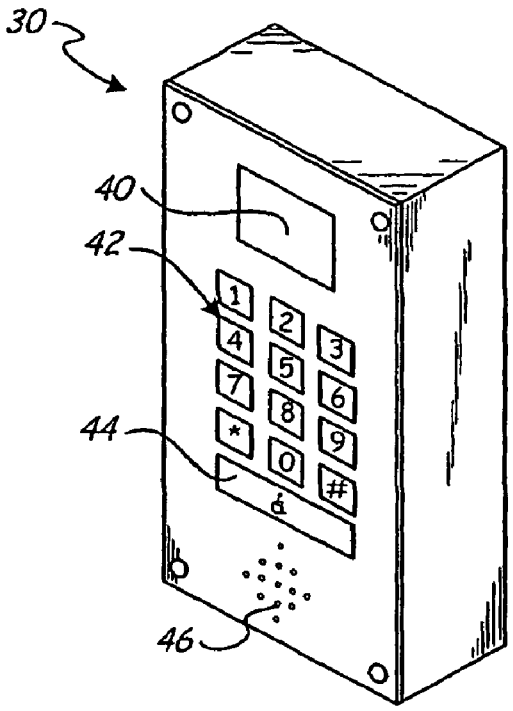
FIG. 2 is a perspective view of a keypad used in the destination entry group elevator system shown in FIG. 1.

FIG. 2 is a perspective view of keypad 30 used in the destination entry group elevator system 10 shown in FIG. 1. Keypad 30 includes display 40, numeric keys 42, accessibility key 44, and electroacoustic transducer or speaker 46. In one embodiment, display 40 is a liquid crystal display (LCD) or light-emitting diode (LED) type display.

When a passenger wishes to be transported between floors in group elevator system 10, the passenger enters his or her desired destination floor using numeric keys 42. For example, if a passenger wants to be transported from lobby floor L to floor F4, the passenger presses the "4" key on numeric keys 42 of keypad 30 located on lobby floor L. This destination input information is then provided to dispatch controller 20. Based on the locations of the cars in elevators 14*a*-14*c* (as provided by car controllers 16*a*-16*c*), dispatch controller 20 provides a signal to keypad 30 that was used by the passenger to enter the destination input information. This signal contains the passenger's elevator assignment. Keypad 30 then directs the passenger to the appropriate elevator using display 40. For example, if the passenger uses keypad 30 nearest elevator 14*c* to enter the destination input information, and the passenger is assigned to elevator 14*a* by dispatch controller 20, the letter "A" appears on display 40. An arrow or other directional symbol may also be displayed on display 40 to guide the passenger in the direction of the assigned elevator.

Figure 3:
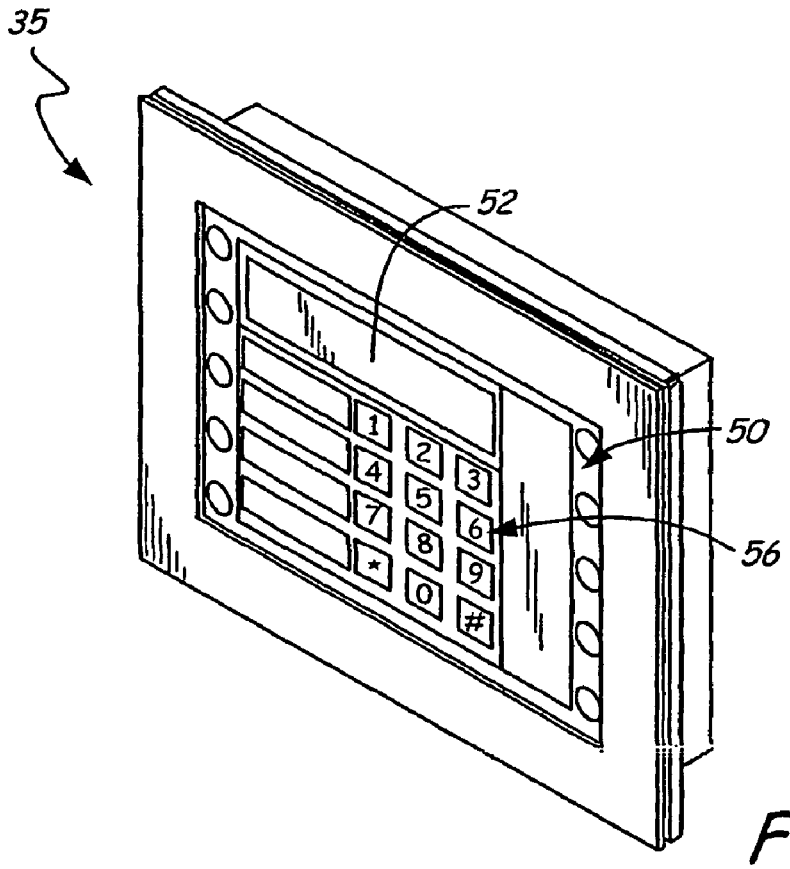
FIG. 3 is a perspective view of a touch screen display used in the destination entry group elevator system shown in FIG. 1.

FIG. 3 is a perspective view of a touch screen display 35 used in the destination entry group elevator system 10 shown in FIG. 1. Touch screen display 35 includes screen 50 for displaying various interactive keys for use by passengers to operate group elevator system 10. The information provided on screen 50 is customizable to the building in which it is provided. In the embodiment shown, screen 50 includes active display 52 and numeric keys 56.

When a passenger wishes to be transported between floors in group elevator system 10, the passenger enters his or her desired destination floor using numeric keys 56. For example, if a passenger wants to be transported from lobby floor L to floor F4, the passenger presses the "4" key on numeric keys 56 of touch screen 35 located on lobby floor L. This destination input information is then provided to dispatch controller 20. Based on the locations of the cars in elevators 14*a*-14*c* (as provided by car controllers 16*a*-16*c*), dispatch controller 20 provides a signal to touch screen 35. This signal contains the passenger's elevator assignment. Touch screen 35 then directs the passenger to the appropriate elevator using active display 52. For example, if the passenger is assigned to elevator 14*a* by dispatch controller 20, the letter "A" appears on active display 52. An arrow or other directional symbol may also be displayed on active display 52 to guide the passenger in the direction of the assigned elevator.

When the destination entry input devices (i.e., keypads 30*a*-30*e*, touch screens 35*a*-35*e*) are brought to building 12 (FIG. 1) for installation, they are not configured for use on any particular floor L-F5 or at any location on the floor. However, it is important that each destination entry input device is configured for use at its installation location, since the directional and distance output provided to the passenger depends on the location of the destination entry device relative to the assigned elevator. To accomplish this, each destination entry device in a building (including those on the same floor) is assigned a unique network address. Based on the network address of the destination entry input device used to register a destination, the elevator controller can determine the appropriate directional and distance output to provide on the destination entry input device. Conventionally, this commissioning system is a two step process, wherein each destination entry input device is connected to dispatch controller 20 and, on a later occasion, each destination entry input device is configured and tested for proper function. This is an elaborate, time-intensive commissioning process, especially in larger buildings having a large number of destination entry devices.

Figure 4:
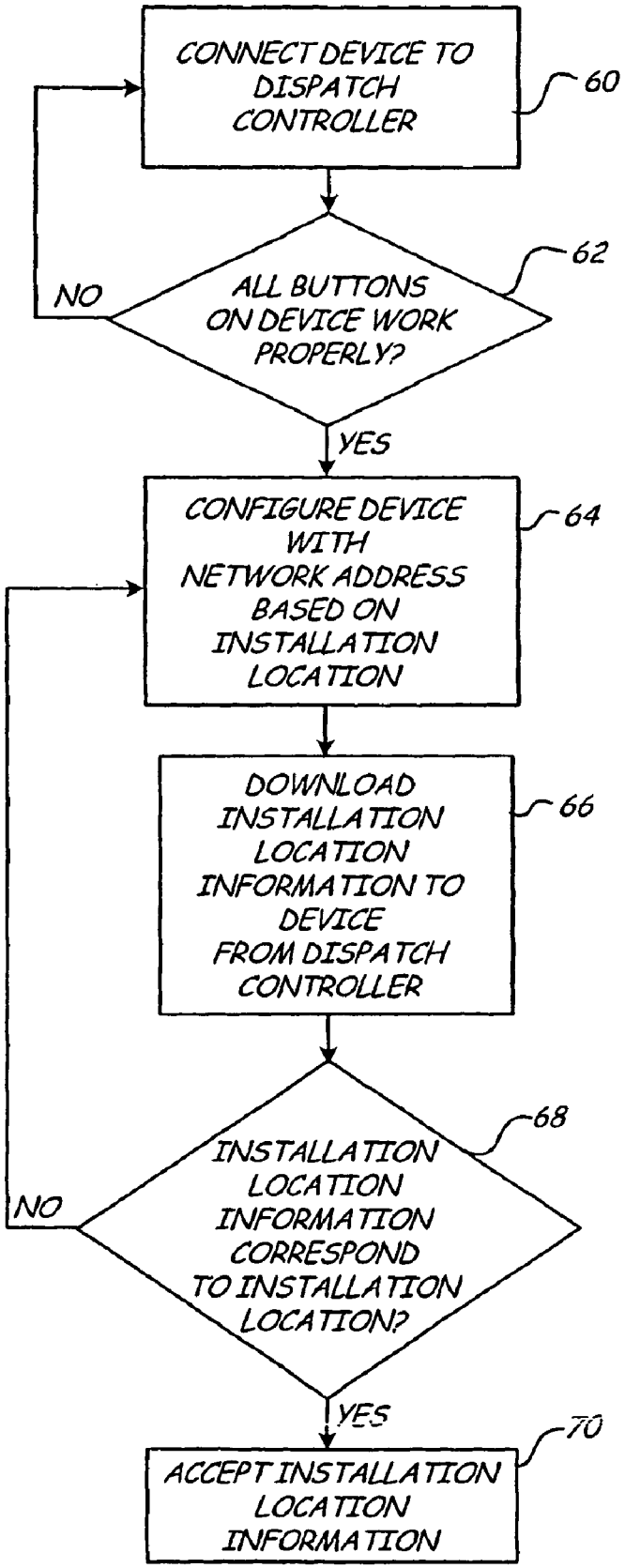
FIG. 4 is a flow diagram for the process of commissioning a destination entry input device according to the present invention.

FIG. 4 is a flow diagram for the process of commissioning a destination entry input device according to the present invention in which the destination entry device is connected, configured, and tested in a single installation process. When a destination entry input device is brought to its installation location, it is connected to dispatch controller 20 (step 60), for example via a data line as described above. When the destination entry input device is connected to dispatch controller 20, a password is typically entered using the keys on the device (i.e., numeric keys 42 on keypad 30 or numeric keys 56 on touch screen display 35) to begin the commissioning process.

When the password has been entered, the keys on the destination entry input device are tested for proper function (step 62). In one embodiment, this involves pressing the keys in response to visual prompts on the display of the destination entry input device (i.e., display 40 on keypad 30 or display 52 on touch screen display 35). For example, the display may show a graphic representation of the keys and instructions to press each key on the keypad to verify functionality. The display may then provide a visual indication that the pressed key is functioning properly (e.g., a checkmark next to the graphic representation of the pressed key). If any of the keys are not functioning properly, the destination entry input device is repaired or replaced and reconnected to dispatch controller 20 (step 60).

If all keys are functioning properly, the display of the destination entry input device then prompts the installer to connect it to the network of group elevator system 10, which includes all destination entry input devices (i.e., keypads 30*a*-30*e*, touch screen displays 35*a*-35*e*) and dispatch controller 20. This typically involves entering a network address on the destination entry input device using the numeric keys (step 64). The network address that is entered must correspond to an address that is stored in dispatch controller 20, which may be obtained by the installer from an installation schedule that includes the network address for each input device based on its location in building 12. For example, if keypad 30*c* is being installed, the network address on the installation schedule for the destination entry input device corresponding to this location (i.e., floor F3 between elevators 14*b* and 14*c*) would be entered on keypad 30*c* during this process. Dispatch controller 20 uses the network address to determine the origin of destination entry information and to provide an appropriate directional and distance output based on the location of the destination entry input device. When the network address has been entered into the destination entry input device, installation location information related to the location of the destination entry input device is downloaded from dispatch controller 20 (step 66).

When the installation location information has been downloaded, the installation location information is reviewed on the display to verify that it corresponds to the installation location of the destination entry input device (step 68). The installation location information may be displayed graphically and may include such information as the floor of installation, the distance and direction to each elevator 14*a*-14*c* from the destination entry input device, and a map of the location of the destination entry input device relative to elevators 14*a*-14*c*. For example, the display of installation location information for touch screen display 35*b* should show that it is located between elevators 14*a* and 14*b* and further away from elevator 14*c* on floor F2. If the installation location information does not correspond to the installation location of the destination entry input device, then the network address was entered incorrectly and must be re-entered (step 64).

If the installation location information does correspond to the installation location, then the installation location information is accepted (step 70), and the commissioning of the destination entry input device is complete. The destination entry input device is then online and may then be tested to verify that elevators 14*a*-14*c* dispatch properly in response to each destination entry.

In summary, the subject invention is directed to the commissioning of a destination entry input device in a group elevator system. The destination entry input device is connected to a dispatch controller. The destination entry input device is connected to a dispatch controller. A network address is input into the destination entry input device corresponding to an installation location of the destination entry input device. When the network address is input, installation location information related to the installation location of the destination entry input device is downloaded to the destination entry input device and verified. Thus, each destination entry input device in a group elevator system may be connected, configured, and tested for functionality in one commissioning process. This is an improvement over the commissioning of conventional destination entry systems that require multiple visits to each destination entry input device in order to complete the commissioning process.

Although the present invention has been described with reference to examples and preferred embodiments, workers skilled in the art will recognize that changes may be made in form and detail without departing from the spirit and scope of the invention.

The invention claimed is:

1. A method for commissioning a destination entry input device in a group elevator system, the method comprising:

connecting the destination entry input device to a dispatch controller;

inputting a network address into the destination entry input device corresponding to an installation location of the destination entry input device; and verifying that installation location information downloaded to the destination entry input device from the dispatch controller based on the network address inputted into the destination entry input device corresponds to the installation location of the destination entry input device.

2. The method of claim 1, and further comprising:

verifying functionality of all keys on the destination entry input device.

3. The method of claim 2, wherein verifying functionality of all keys comprises:

pressing each key on the destination entry device; and verifying a visual output on the destination entry device in response to the key pressed.

4. The method of claim 1, wherein verifying installation location information related to the installation location comprises verifying that floor location and elevator relative position information corresponds to the installation location of the destination entry input device.

5. The method of claim 1, wherein the floor location and elevator relative position information is provided on a display on the destination entry input device.

6. The method of claim 5, wherein the elevator relative position information comprises the distance and direction from the destination entry input device to each elevator in the group elevator system.

7. The method of claim 1, and further comprising:

accepting the installation location information to activate the destination entry input device.

8. The method of claim 1, wherein the destination entry input device comprises a keypad.

9. The method of claim 1, wherein the destination entry input device comprises a touch screen.

10. A method for commissioning a destination entry input device in a group elevator system, the method comprising:

installing the destination entry input device at an installation location;

connecting the destination entry input device to a dispatch controller;

verifying functionality of all keys on the destination entry input device;

inputting into the destination entry input device a network address stored in the dispatch controller that is specific to the installation location of the destination entry input device; and verifying installation location information downloaded to the destination entry input device from the dispatch controller based on the input network address inputted into the destination entry input device corresponds to the installation location of the destination entry input device.

11. The method of claim 10, wherein verifying installation location information related to the installation location comprises verifying that floor location and elevator relative position information corresponds to the installation location of the destination entry input device.

12. The method of claim 11, wherein the floor location and elevator relative position information is provided on a display on the destination entry input device.

13. The method of claim 12, wherein the elevator relative position information comprises the distance and direction from the destination entry input device to each elevator in the group elevator system.

14. The method of claim 10, wherein verifying functionality of all keys comprises:

pressing each key on the destination entry device; and verifying a visual output on the destination entry device in response to pressing each key.

15. The method of claim 10, and further comprising:

accepting the installation location information to activate the destination entry input device.

16. The method of claim 10, wherein the destination entry input device comprises a keypad.

17. The method of claim 10, wherein the destination entry input device comprises a touch screen.

* * * * *